US011912460B2

(12) United States Patent
Stengel, Jr. et al.

(10) Patent No.: US 11,912,460 B2
(45) Date of Patent: Feb. 27, 2024

(54) DUAL ACTING POP TOP LID

(71) Applicants: Gilbert P. Stengel, Jr., Burlington, KY (US); Tracey Martinez, Waynesville, OH (US)

(72) Inventors: Gilbert P. Stengel, Jr., Burlington, KY (US); Tracey Martinez, Waynesville, OH (US)

( * ) Notice: Subject to any disclaimer, the term of this patent is extended or adjusted under 35 U.S.C. 154(b) by 784 days.

(21) Appl. No.: 16/976,281

(22) PCT Filed: Mar. 1, 2019

(86) PCT No.: PCT/US2019/020326
§ 371 (c)(1),
(2) Date: Aug. 27, 2020

(87) PCT Pub. No.: WO2019/169281
PCT Pub. Date: Sep. 6, 2019

(65) Prior Publication Data

US 2021/0053721 A1 Feb. 25, 2021

Related U.S. Application Data

(60) Provisional application No. 62/726,214, filed on Sep. 1, 2018, provisional application No. 62/637,043, filed on Mar. 1, 2018.

(51) Int. Cl.
*B65D 17/34* (2006.01)
*B65D 17/40* (2006.01)

(52) U.S. Cl.
CPC ..... *B65D 17/34* (2018.01); *B65D 17/40* (2018.01)

(58) Field of Classification Search
CPC ..... B65D 17/34; B65D 17/40; B65D 2517/0013; B65D 2517/0019; B65D 17/4012; B65D 17/4011; B65D 17/404
USPC ..... 220/269, 271
See application file for complete search history.

(56) References Cited

U.S. PATENT DOCUMENTS 3,254,790 A 6/1966 Dunn
3,294,275 A * 12/1966 Ciro Mileto ..... B65D 17/4012 D9/438
3,335,899 A 8/1967 Dunn
3,773,209 A 11/1973 Schane
4,301,940 A * 11/1981 Cvacho ..... B65D 17/4012 220/269
4,801,038 A 1/1989 Groigorenko
5,145,086 A 9/1992 Krause
(Continued)

*Primary Examiner* — James N Smalley
(74) *Attorney, Agent, or Firm* — Jenei LLC; Stephen R. Jenei

(57) ABSTRACT

A container includes an end wall having a rivet and a frangible score line that defines a curved tongue shaped panel. The frangible score line terminates at each end substantially on a radial line extending from a lever mounting hole formed within the curved tongue shaped panel. A tab is riveted to the lever-mounting hole to act as second-degree lever. The tab has a first actuating point extending toward the distal looping portion of the frangible score line. The tab has a fulcrum portion extending opposite to the first actuating point and terminating within the curved tongue shape. Lifting of the first actuating point pulls upward on the curved tongue shaped panel at the distal looping portion imparts a shear force of the frangible score line to initiate upward rolling of an extended portion of the curved tongue shaped panel.

5 Claims, 13 Drawing Sheets

(56) References Cited

U.S. PATENT DOCUMENTS

| | | | | |
|---|---|---|---|---|
| 5,190,149 | A * | 3/1993 | Krause | B65D 17/4012 220/269 |
| 5,975,327 | A * | 11/1999 | Funk | B65D 17/4014 220/269 |
| 6,290,084 | B1 | 9/2001 | Louie | |
| 8,870,012 | B2 | 10/2014 | Stengel, Jr. | |
| 9,457,930 | B1 | 10/2016 | Stengel, Jr. et al. | |
| 2010/0126992 | A1 | 5/2010 | Phillips | |
| 2010/0251798 | A1 | 10/2010 | Adams | |
| 2013/0037543 | A1 | 2/2013 | McClung | |
| 2015/0001220 | A1 | 1/2015 | Neiner | |
| 2016/0023802 | A1 | 1/2016 | Brandtner | |
| 2016/0130031 | A1 | 5/2016 | Tashiro et al. | |
| 2017/0129644 | A1 | 5/2017 | Jobges | |

* cited by examiner

DUAL ACTING POP TOP LID

CROSS-REFERENCE TO RELATED APPLICATION

The present application claims priority to U.S. Provisional Patent Application No. 62/637,043, filed on Mar. 1, 2018, and to U.S. Provisional Patent Application No. U.S. provisional 62/726,214, filed on Sep. 1, 2018.

BACKGROUND

1. Technical Field

The present disclosure generally relates to and in particular to pull tab opened containers.

2. Description of the Related Art

Pop top can lids are dominated by the common stay-on tab, a device that when lifted forces a scored panel down and into a can. This opening means is comprised of a number of elements: (a) a lid; (b) a rivet made of metal in the lid; (c) a scored panel opening; and (d) a tab that is held down on the lid by the rivet. Actuating the tab by lifting causes downward pressure on the scored panel by means of a first-class lever action using the rivet as a fulcrum.

The fundamental architecture underlying the operation of a current stay-on tab has not changed in several decades. The tab comprises a first-class lever and using the rivet as a fulcrum exerts a downward pressure on a scored panel opening in a can end shell.

Stay-on tabs have always suffered due to several faults. The most common complaint is the presence of a stay-on tab riveted to the top of a can blocking a user from drinking directly from the can. Once actuated, the stay-on tab sits rather proud of the can lid shell and is placed so that a user experiences the familiar nose bump when drinking from the can.

Another common complaint is the pressure needed to force the scored panel downward is in a range that those with disabilities related to hand strength find opening forces are too high. Six or more pounds of pressure have to be brought to bear lifting the stay-on tab to actuate the device as a lever.

In addition, the force required to shear the scored panel apart from the lid is in a range that often the score shearing action will fail due to the score being too shallow. In the existing art, the moment arm length and angle of incidence applied to shear the scored panel is limited in scope due to the fact that the rivet is immovable. When using a first-class lever to shear an opening in the can, an immovable fulcrum limits where the resistance load can bear. This constriction causes a percentage of cans to simply not open due to limits in shear force on the scored opening.

Another common complaint related to existing stay-on tabs is incomplete emptying of a beverage can after pouring or drinking the contents of the can. This incomplete emptying is related to shape and size of scored panel openings created by the existing art. The existing stay-on tab is limited in ability to create a large enough opening, extending close to the end wall of the can. Increasing opening sizes and extensions with the existing art result in lower shear forces applied to scored panel openings and the resultant increase in failure rates that attend.

In commonly owned U.S. Pat. No. 9,457,930, whose disclosure is hereby incorporated by reference in its entirety, a pop-top can had a tab acted as a second-degree lever to lift a region of the top of the can in an upward direction. The opening action provided a more sanitary and healthy solution. However, further improvements are desired. Those skilled in the art have searched for ways to increase force on the scored panel while lowering the operating forces to lift a tab.

Other existing art in the genre attempt to design a beverage container end that allows a wider and larger opening in the can. In this fashion, a container could be more completely emptied of contents. However, large opening designs often effect a detachable panel with swallowing, litter and sharp edge hazards that are attendant and well known in the art. The present invention mitigates these problems by effecting a large opening end that remains attached to the beverage can.

BRIEF SUMMARY OF THE INVENTION

According to a one aspect, a container comprises an end wall having a rivet and a frangible score line that defines a curved tongue shaped panel. The frangible score line has a semicircular arcing portion from a first lateral side to a proximal side and to a second lateral side, continuing to a distal looping portion that encompasses the rivet on a distal side and the first lateral side. The frangible score line terminates at each end substantially on a radial line extending from the rivet. A tab is riveted to the end wall shell to act as second-degree lever. The tab includes a first actuating point extending toward the distal looping portion of the frangible score line. The tab includes a fulcrum portion extending opposite to the first actuating point and terminating within the curved tongue shape. Lifting of the first actuating point pulls upward on the curved tongue shaped panel at the distal looping portion imparting a shear force of the frangible score line to initiate upward rolling of an extended portion of the curved tongue shaped panel.

In another exemplary embodiment, the tab further comprises a second actuating point extending across a second lateral side portion of the frangible scored line. The second actuating point is actuated after the first actuating point to roll up the curved tongue shaped panel toward the first lateral side. In a particular aspect of the other exemplary embodiment, actuation of the first actuating point folds the extending portion of curved tongue shaped panel proximally onto the curved tongue shaped panel. The frangible score line terminates at each end substantially on the radial line extending from the lever mounting hole toward the first lateral side. Actuation of the second actuating point upwardly rolls the folded extending portion of the curved tongue shaped panel toward the first lateral side. Continued actuation of the second actuating point folds back distally the rolled curved tongue shaped panel onto the end wall.

In an additional embodiment, a container includes an end wall having a rivet and a frangible scored line that defines an outwardly spiraling curved tongue shaped panel that diverges to define a circular aperture that encompasses substantially a top surface of the end wall. The container includes a stay-on tab that is riveted to a central portion of the end wall to act as second-degree lever. Lifting of the tab upward sheers a portion of the frangible scored line upward separating the outwardly spiraling curved tongue shaped panel to expose the circular aperture.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
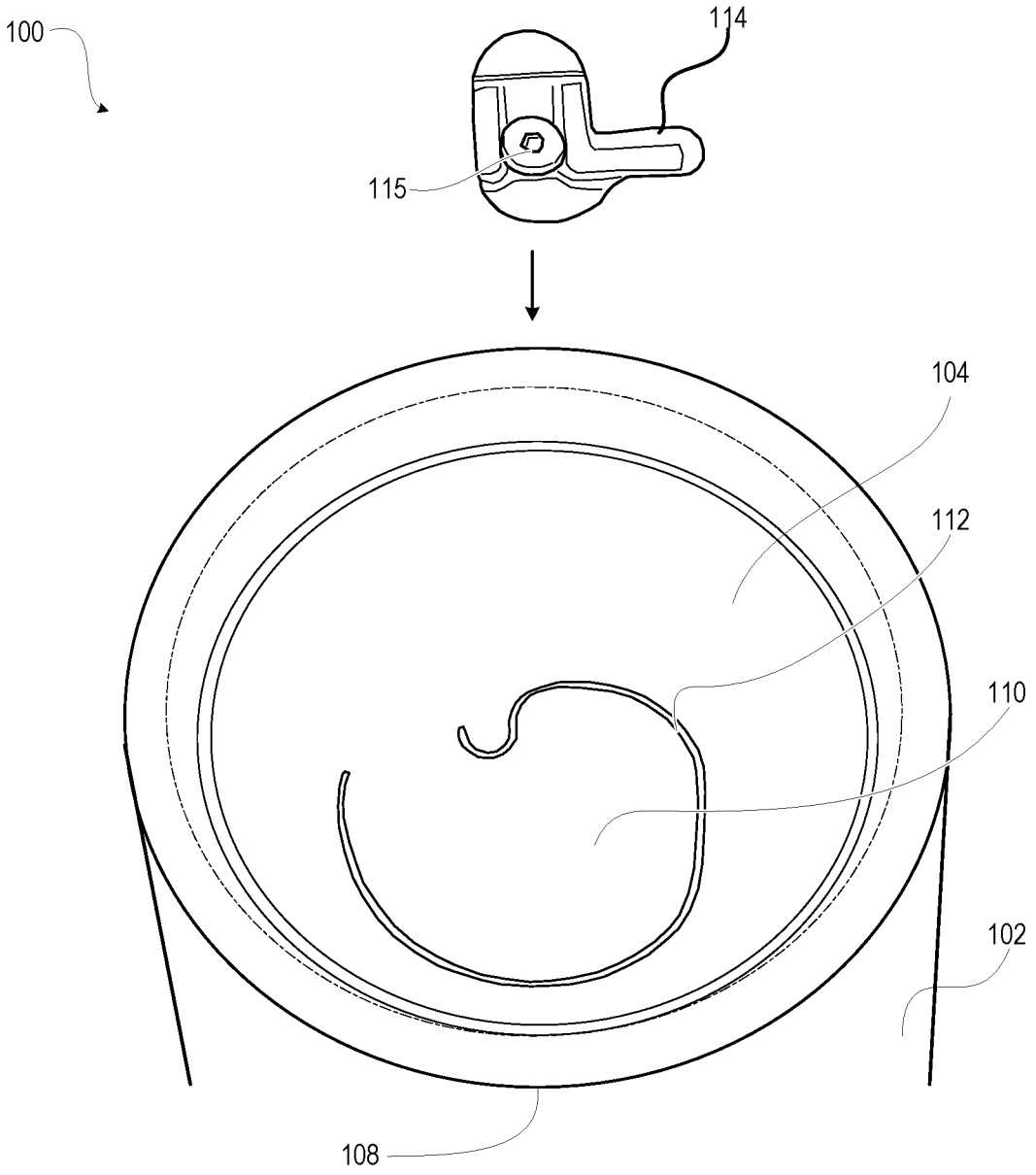
FIG. 1 is a top isometric view illustrating an example pop top lid having a disassembled lever arm with two points of actuation, according to one or more embodiments.

The present invention is directed to a container, such as an aluminum beverage container or can. Although other containers are applicable to the various embodiments of the present invention described herein, for the purpose of this application the term "can" or "container" is intended to apply to any such container, including but not limited to an aluminum can.

The illustrative embodiments provide a container that includes an end wall having a rivet and a frangible score line that defines a curved tongue shaped panel. The frangible score line terminates at each end substantially on a radial line extending from a lever mounting hole formed within the curved tongue shaped panel. A tab is riveted to the rivet to act as second-degree lever. The tab has a first actuating point extending toward the distal looping portion of the frangible score line. The tab has a fulcrum portion extending opposite to the first actuating point and terminating within the curved tongue shape. Lifting of the first actuating point pulls upward on the curved tongue shaped panel at the distal looping portion imparts a shear force of the frangible score line to initiate upward rolling of an extended portion of the curved tongue shaped panel.

According to aspects of the present innovation, the rivet and tab move with a portion of lid separated at the score line and displaced to expose contents of the can. The limitations inherent in having an immovable rivet are removed. The tab comprises a second-class lever with the end of the tab becoming the fulcrum bearing on the end shell and the panel. The rivet is the resistance in this design, lifting up and pulling part of the panel to create an opening in the can. By moving the rivet inside the scored opening, a bend can be created in the panel. From within this bend, the remaining scored opening can be pushed down or pulled out to allow a user to access the can contents. Changing the basic architecture of a stay-on tab to a second-class lever also carries the effect of allowing the tab assembly to be smaller, thus saving cost in production due to a lower requirement for metal used. Increasing shear forces can also reduce cost in the industry by reducing the number of score residual failures, allowing further savings by reducing overall losses. Larger scored panel opening sizes are possible with this architecture, allowing for more complete pours and emptying of can contents.

A pop top lid comprised of a lever arm assembly with one or two points of actuation, attached to a can lid with a rivet.

A scored panel in a can lid with the score line beginning near the rivet, traversing around the rivet so that the rivet lies within the scored panel area.

The lever arm assembly pulls up, perpendicular to the can lid using the first actuation point. The rivet is attached to this extension of the lever arm assembly; outside and above the bend line and pulling the rivet up creates an aperture in the score immediately around and above the rivet. The first lever arm operates as a class two lever, pressing against the scored panel and an area outside the score to lift the rivet. The bend line created by this actuation is within and part of the scored panel area, not on the tab/lever arm assembly. The assembly does not bend; the panel bends as the first lever arm is lifted.

Outward Turning: In one embodiment, continuing the pull, the top ⅕ or so of the score is folded over the top of the second lever arm extension of the assembly, and on top of the first lever arm, leaving the second lever arm exposed for a second action. The second lever arm can extend outside the score onto the lid or, alternatively, it can be rather short and extend just outside the folded portion of the panel. Lifting the second lever arm creates an upward force from within the fold of the previously detached scored panel created by the first lever arm actuation. Creating force from within the folded panel with the second lever arm rather than using the rivet to pull or push to shear the score allows for greater force to bear on the score without a device failure associated with excess metal in the score, or tab failure around the rivet. This force can drive the scored panel down, or lift the scored panel up, depending on which side of the panel hinge area the second lever arm is actuated.

Moving this second lever arm up, perpendicular to the lid and on the opposite side of the rivet from the hinged panel area, pulls the remaining scored panel substantially out of the lid. This action shears the remaining score and allows the user to push the scored panel to the side, hinging on the remaining attached lid portion.

Although not an all-inclusive list of uses or advantages, aspects of the first embodiment for an outward turning scored panel include the following:

(i) There are no metal parts in contact with the liquid in the can, increasing sanitation;

(ii) An aluminum can may become part of a promotion or game piece by placing information inside the can that can only be seen after actuation;

(iii) Operating forces are considerably lower than the existing art;

(iv) A larger opening can be scored compared to the existing art; and (v) Shear forces across a score can be dramatically increased.

The most obvious objection to this design turning out is that upon full actuation and opening, the sharp edge of the scored panel is exposed. This presents a hazard, as the thin aluminum can easily cause a cut. In one version of this design, the scored panel is attached to a portion of the tab that extends beyond the boundary of the score. This attachment can be made by an adhesive, a weld or any means that can bring the two metal faces together in such a way that actuation and bending forces do not separate them. The tab portion extending beyond the score radius will prevent the user from touching the sharp edge. One other possibility is that the tab extension outside the score radius can be a hollow or curled shape that can enclose the sharp edge of the scored panel as it comes unsealed from the can lid. These design elements are not essential to the actual opening action and are offered as possibilities.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

Figure 2:
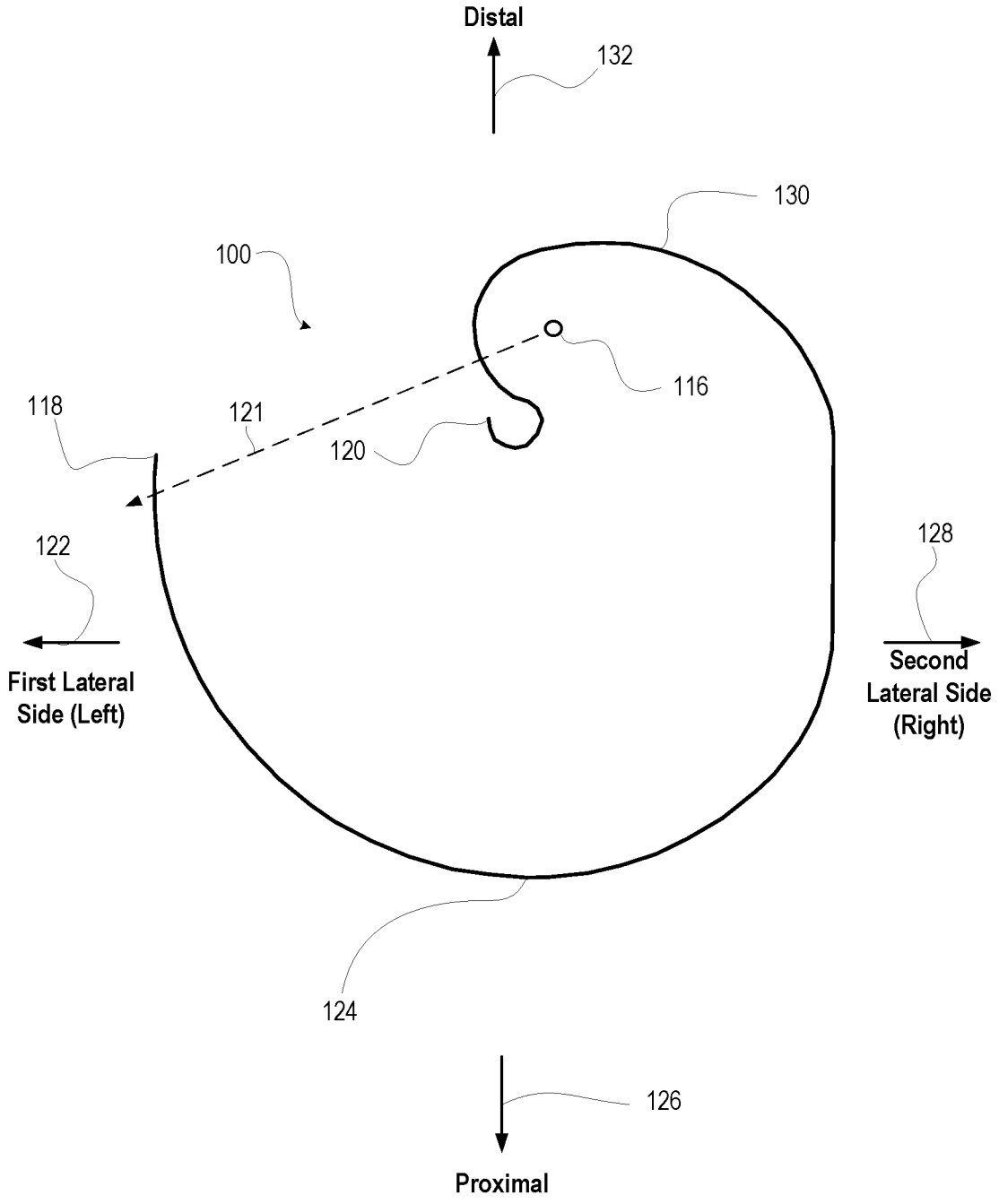
FIG. 2 is a top detail view illustrating a score pattern of the example pop top lid of FIG. 1, according to one or more embodiments.

FIG. 1 illustrates a container 100 having a cylindrical sidewall 102 closed on top by a disc-shaped end wall 104. An opening 106 (FIG. 10) is formed on a proximal portion 108 of the end wall 104 by tearing away a curved tongue shaped panel 110 at a frangible score line 112. A tab 114 is provided for attachment such as by a fastener or a rivet 115 to act as second-degree lever to cause the tearing away. FIG. 2 illustrates that the frangible score line 112 terminates at outer and inner ends 118, 120 substantially on a radial line 121 extending from the lever mounting hole 116 generally toward the first lateral side 122, which for clarity is illustrated in FIGS. 1-2 as being on the left. The frangible score line 112 of the curved tongue shaped panel 110 has a semicircular arcing portion 124 from the first lateral side 122 to a proximal side 126 and to a second lateral side 128, which is illustrated in FIG. 1 as being on the right. The frangible score line 112 continues from the proximal side 126 to a distal looping portion 130 that encompasses the lever mounting hole 116 on a distal side 132 and the first lateral side 122.

Figure 3:
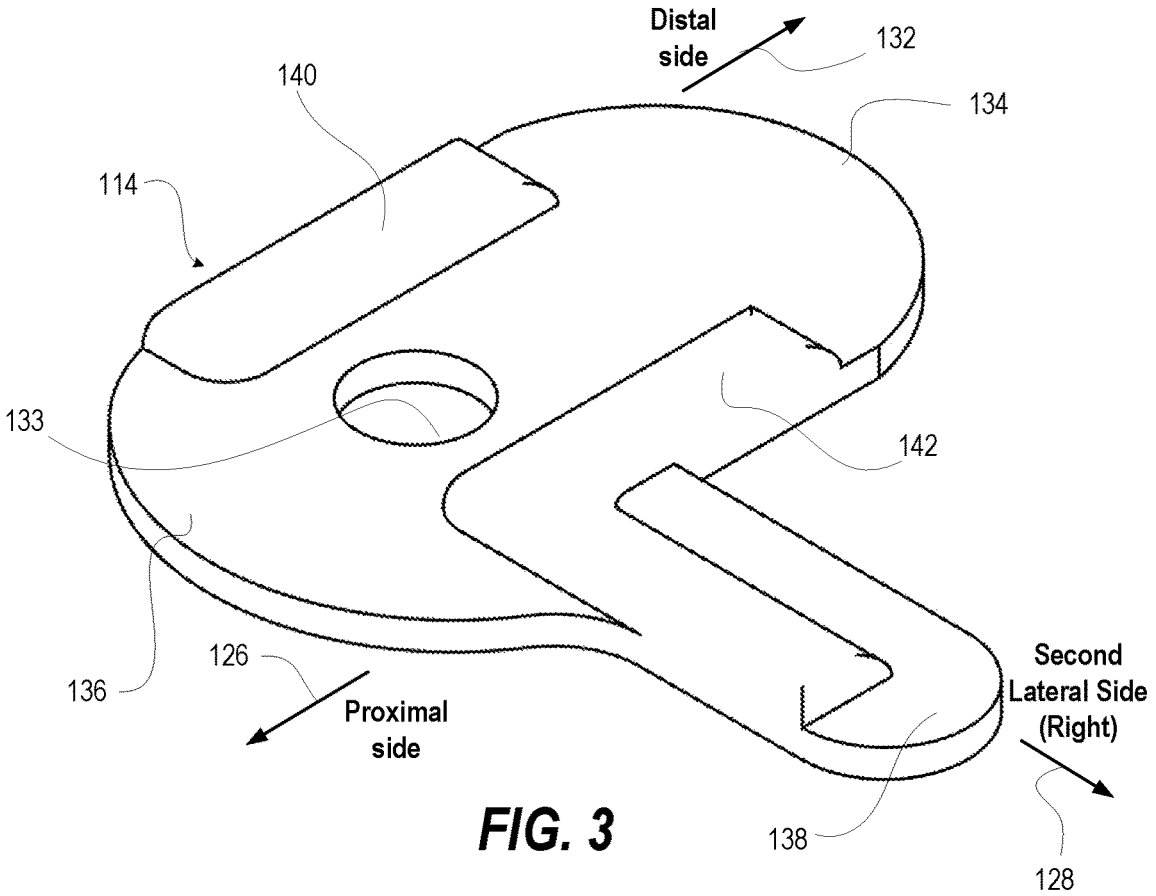
FIG. 3 is an isometric view illustrating one version of the lever arm of FIG. 1, according to one or more embodiments.

FIG. 3 illustrates that the tab 114 with a through hole 133 for being riveted and has a first actuating point 134 that extends toward the distal side 132. The tab 114 has a fulcrum portion 136 extending opposite to the first actuating point 134 toward the proximal side 110. The tab 114 further has a second actuating point 138 that extends toward the second lateral side 128. A left stiffener 140 is formed by a thickened or folded over portion of the first actuating point 134 for additional strength. Similarly, an L-shaped stiffener 142 along a right side of the first actuating point 134 and along a proximal side of the second actuating point 138 provide additional strength to both first and second actuating points 134, 138.

Figure 4:
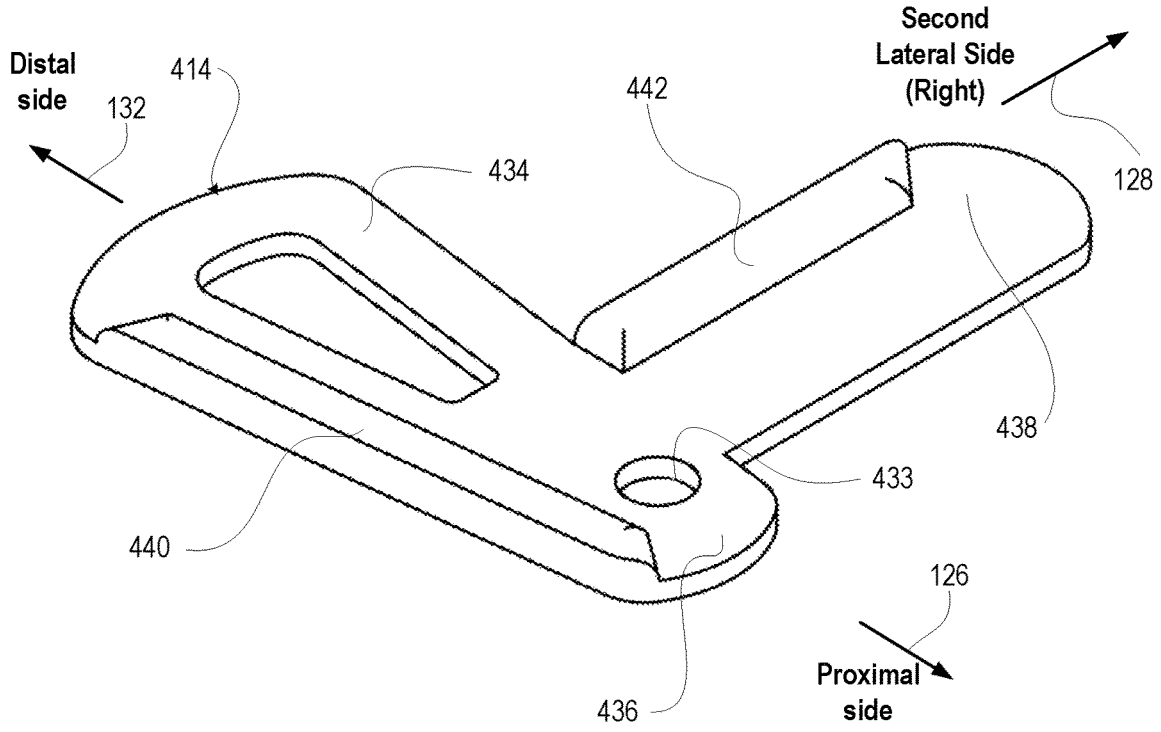
FIG. 4 is an isometric view illustrating another version of the lever arm of FIG. 1, according to one or more embodiments.

FIG. 4 illustrates another version of a tab 414 with a through hole 433 and that has a first actuating point 434 that extends toward the distal side 132. The tab 414 has a fulcrum portion 436 extending opposite to the first actuating point 434 toward the proximal side 126. The tab 414 further has a second actuating point 438 that extends toward the second lateral side (right) 128. A left stiffener 440 is formed by a thickened or folded over portion of the first actuating point 434 for additional strength. Similarly, an L-shaped stiffener along a second lateral side (right) 128 of the first actuating point 434 and along a proximal side 126 of the second actuating point 438 provide additional strength to both first and second actuating points 434, 438.

Figure 5:
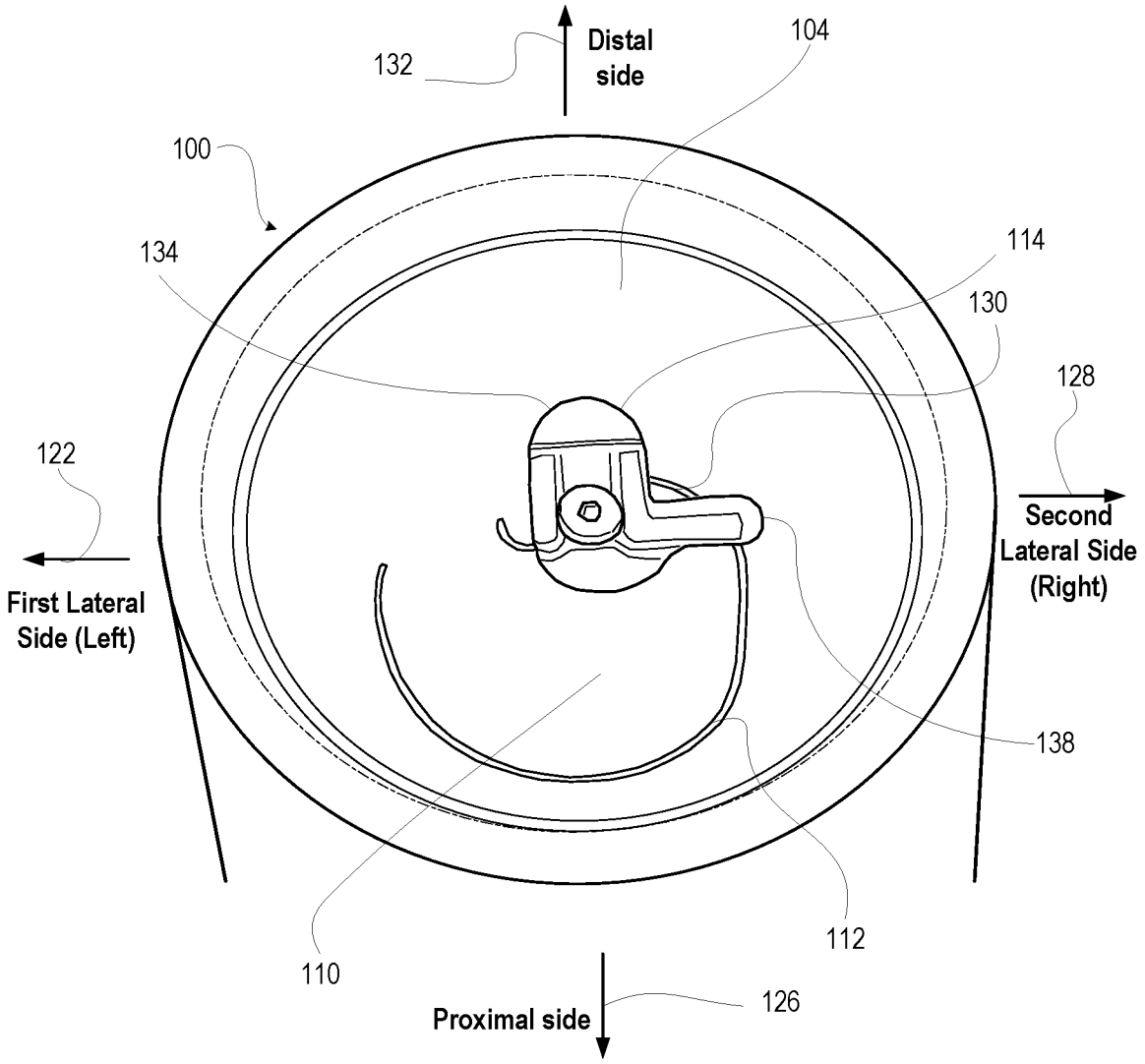
FIG. 5 is a top isometric view illustrating the example pop top lid assembled with a riveted lever arm having two points of actuation, according to one or more embodiments.

FIG. 5 illustrates the container (can) 100 in an initial unopened state with the end wall 104 assembled with the tab 114 that is attached by a rivet 115. The tab 114 has the first actuating point 134 extending toward the distal looping portion 130 and over the frangible score line 112. The second actuating point 138 extends across a second lateral side portion of the frangible scored line 112. The tab 114 has a fulcrum portion 136 extending opposite to the first actuating point 134 and terminating within the curved tongue shaped panel 110.

Figure 6:
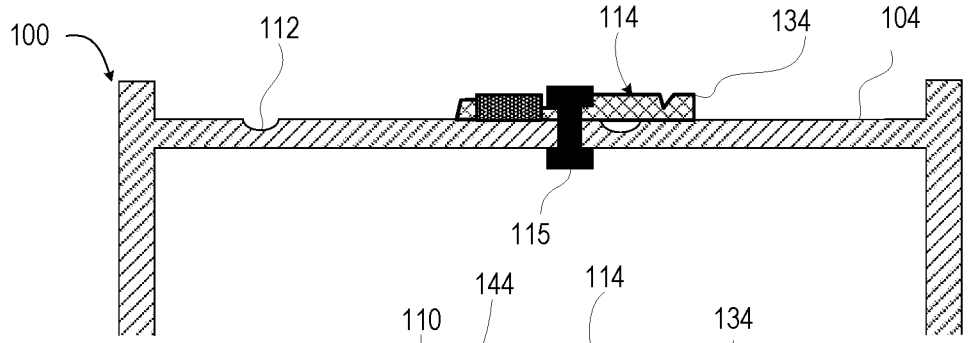
FIG. 6 is a side diagrammatic view illustrating the lever arm of FIG. 5 in an initial sealed position of the pop top lid, according to one or more embodiments.
Figure 7:
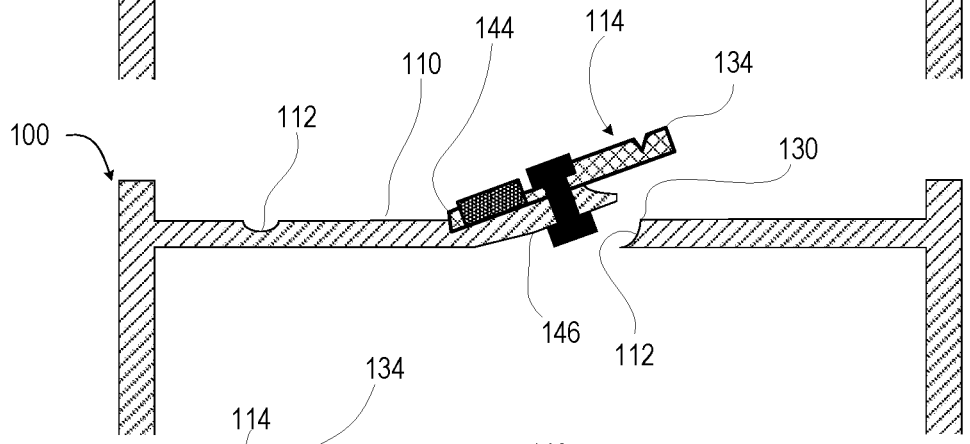
FIG. 7 is a side diagrammatic view illustrating the lever arm of FIG. 6 actuated in a first direction to unseal the pop top lid, according to one or more embodiments.
Figure 8:
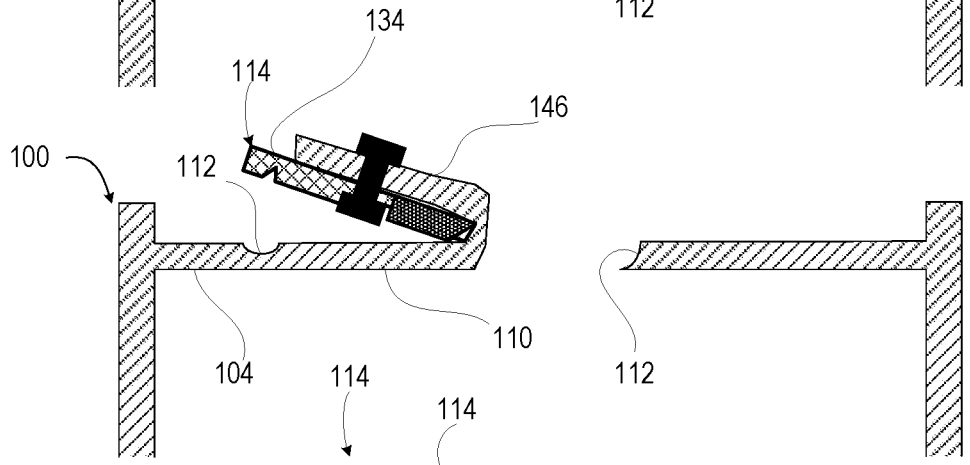
FIG. 8 is a side diagrammatic view illustrating the lever arm of FIG. 7 further actuated in the first direction, according to one or more embodiments.
Figure 9:
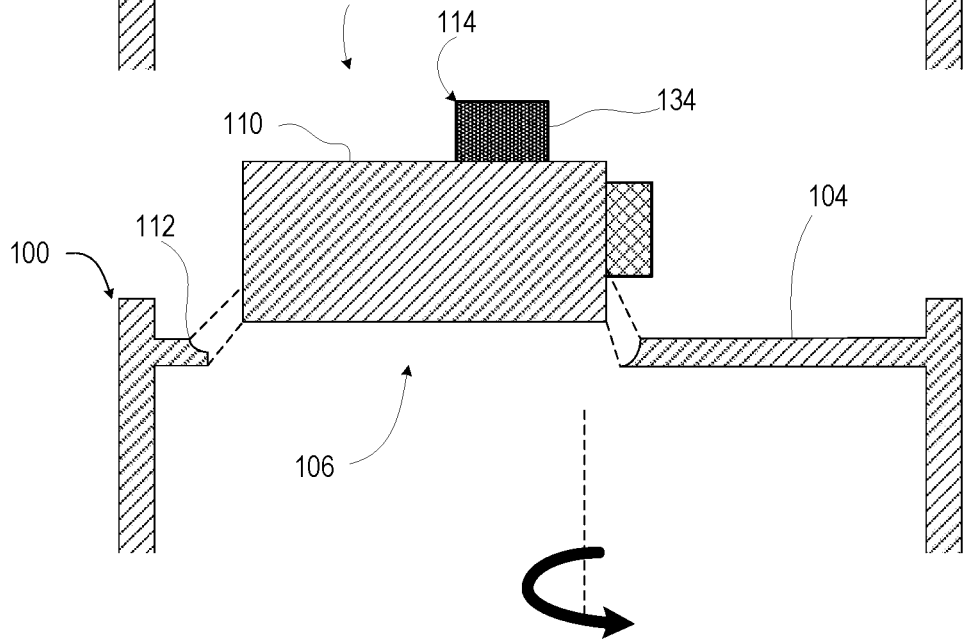
FIG. 9 is a side diagrammatic view illustrating the lever arm of FIG. 8 actuated in a second direction, according to one or more embodiments.

FIGS. 6-9 illustrate a diagrammatic sequence of opening the container 100 with the frangible score line 112 and tab 114. FIG. 6 illustrates, from a right-side vantage point in cross section, the unopened container 100 having the tab 114 riveted to the end wall 104 by the rivet 115. FIG. 7 illustrates the first actuating point 134 of the tab 114 being lifted to sheer a distal looping portion 130 of the frangible scored line 112. The first actuating point 134 also creates a primary fold 144 in an extending portion 146 of the curved tongue shaped panel 110. FIG. 8 illustrates the tab 114 and the extending portion 146 of the curved tongue shaped panel 110 further folded down onto or close to the end wall 104 over top of an undisturbed portion of the curved tongue shaped panel 110, completing actuation of the first actuating point 134. FIG. 9 illustrates, from a proximal vantage point, initial actuation upward of the second actuating point 138 causing continued shearing of the frangible scored line 112. When the second actuating point 138 is fully actuated after the first actuating point 134 to roll up the curved tongue shaped panel 110 toward the first lateral side 122 and then to fold distally onto the end wall 104 away from the opening 106.

Full Aperture End Embodiments With Stay-On Tab

The claimed innovation falls within the realm of aluminum beverage can end closures. The common form of an aluminum can opening device is the "stay-on tab", a device which when actuated pushes a scored panel down and into a beverage can, creating an opening. This device was adopted into widespread use in the mid 1970's after years of "pull tab" use by the public and beverage makers. Pull tabs created an opening in a beverage can by lifting a ring on a can end wall, creating an opening and separating from a can to reveal that opening for use. The separated ring pull tab was a common litter problem in the late 1960's and early 1970's. The invention and adoption of the stay-on tab solved the litter problem of the pull tab and has become the industry standard for beverage cans in the ensuing decades.

Recently some beverage companies have adopted a variation on the old pull tab wherein the can end wall is completely removed using a pull ring and a scored panel in the end wall that circumscribes the end shell wall in a removable panel. This has become known as a "full aperture end" and is used where beverage manufacturers seek to allow consumers to use aluminum cans as a more complete drinking vessel—one that allows closer inspection of a can contents and easier access to the can interior. The current version of the full aperture end suffers from two major problems. In order to create sufficient leverage to shear a full aperture score, the ring and rivet assembly is located near the perimeter of the score line, considerably offset from the center of the can end wall. This offset rivet location increases cost of manufacture and necessitates extra steps in creating this end. The second problem is left over from the 1960's, the full aperture end use results in a separated scored panel with the attendant problems of disposal and danger from loose sharp edges.

Figure 10:
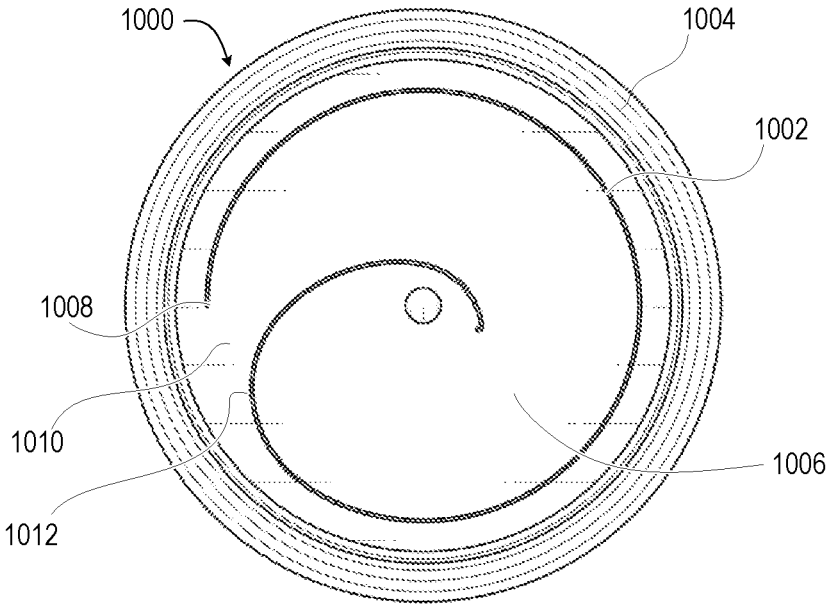
FIG. 10 is top view illustrating an example spiral turning score line of a full aperture pop top lid, according to one or more embodiments.
Figure 11:
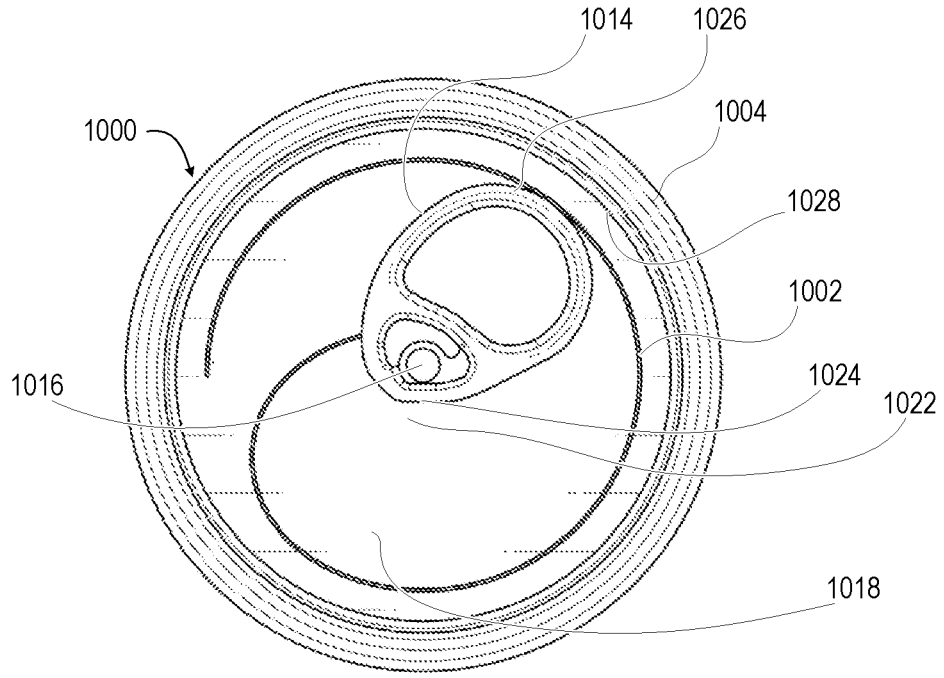
FIG. 11 is a top view illustrating an example stay-on tab attached to the full aperture pop top lid of FIG. 10, according to one or more embodiments.
Figure 12:
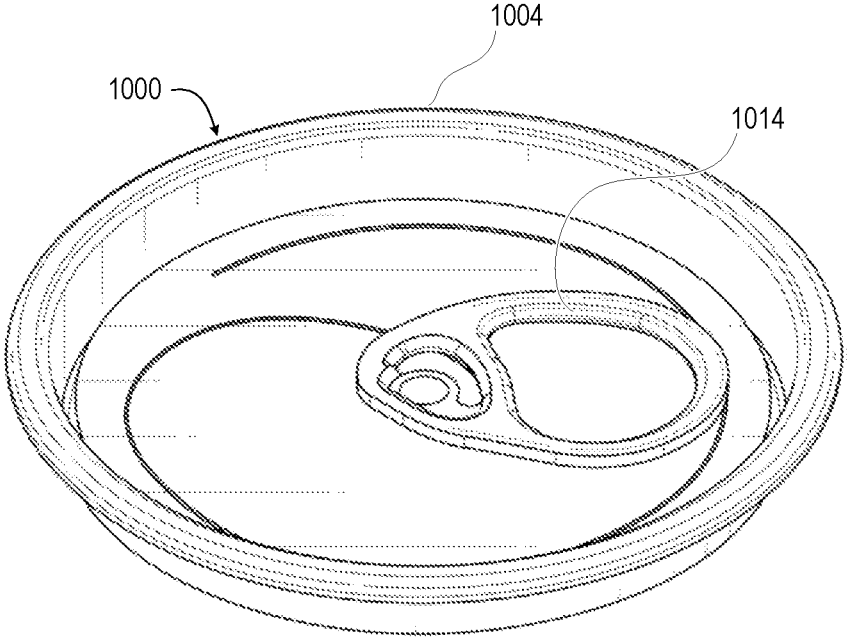
FIG. 12 is an isometric view illustrating the example stay-on tab attached to the full aperture pop top lid of FIG. 11, according to one or more embodiments.
Figure 13:
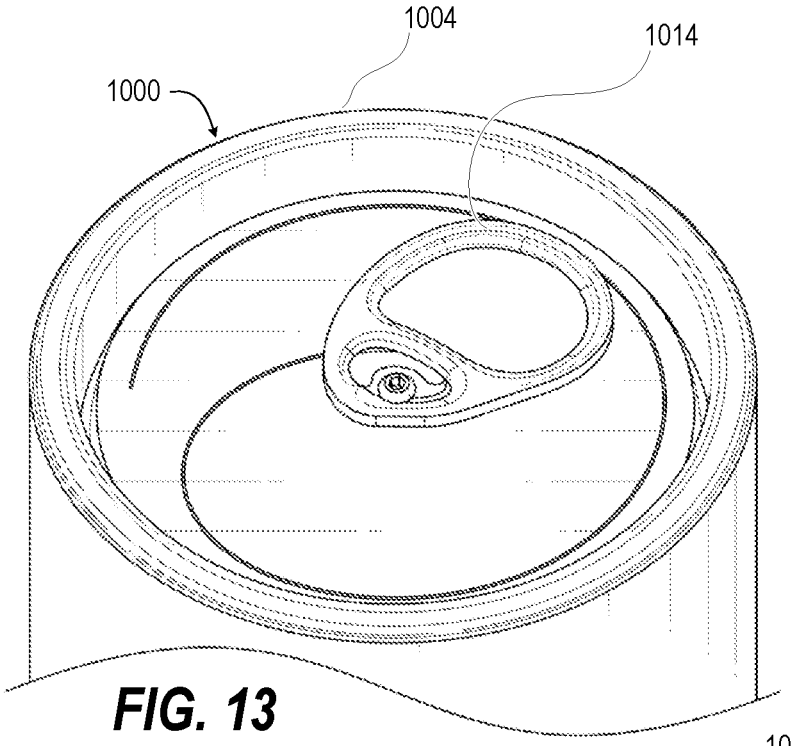
FIG. 13 is an isometric view illustrating the example stay-on tab bent upward slightly from the full aperture pop top lid of FIG. 12, according to one or more embodiments.
Figure 14:
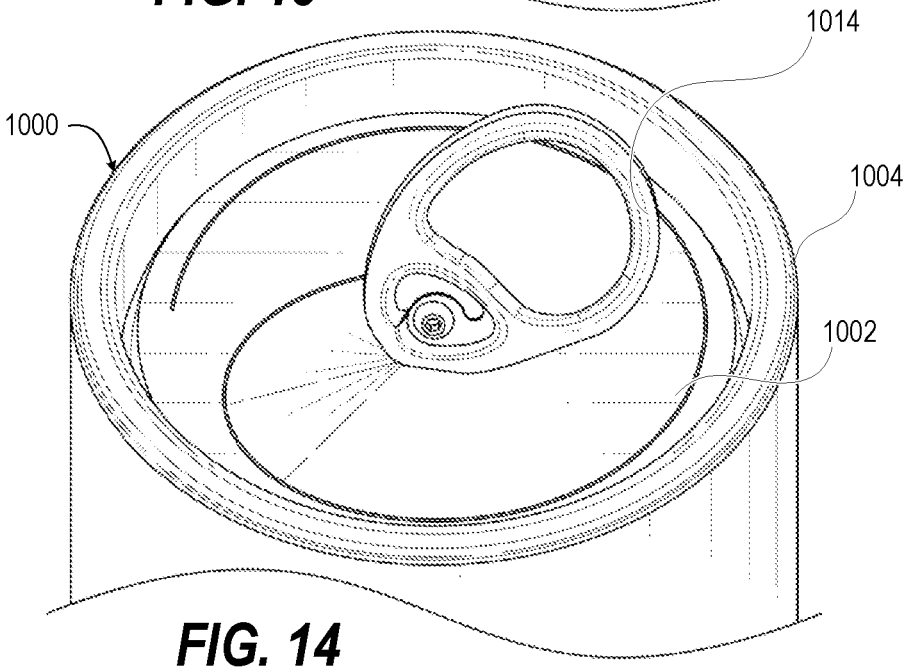
FIG. 14 is an isometric view illustrating the example stay-on tab bent actuated further from the full aperture pop top lid of FIG. 13 to form an aperture in the scored line, according to one or more embodiments.
Figure 15:
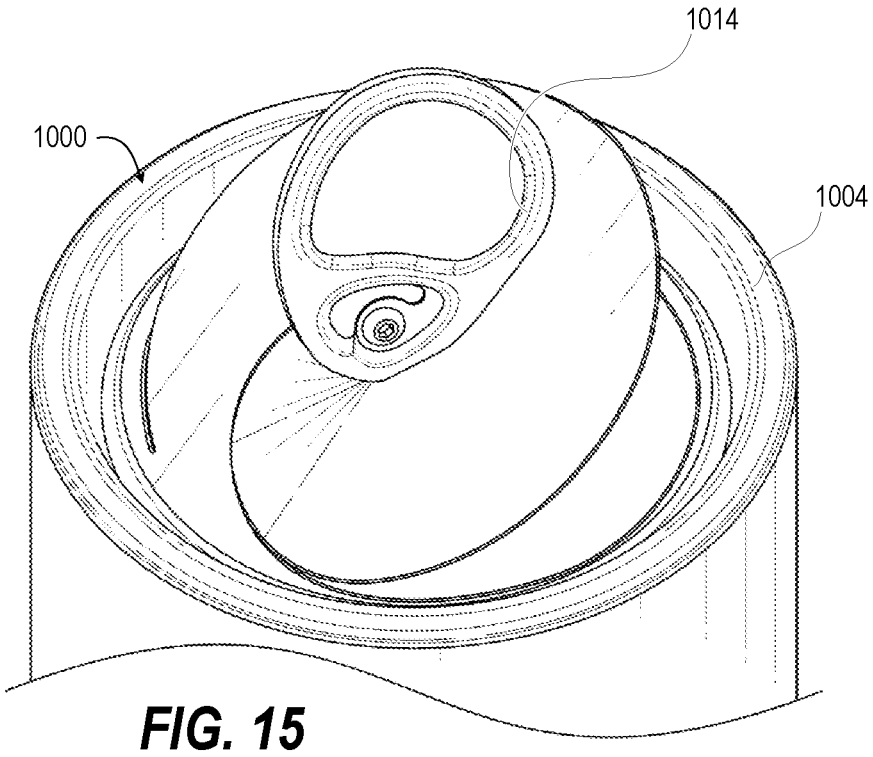
FIG. 15 is an isometric view illustrating the example stay-on tab bent actuated further from the full aperture pop top lid of FIG. 14 to completely sheer the scored line, according to one or more embodiments.
Figure 16:
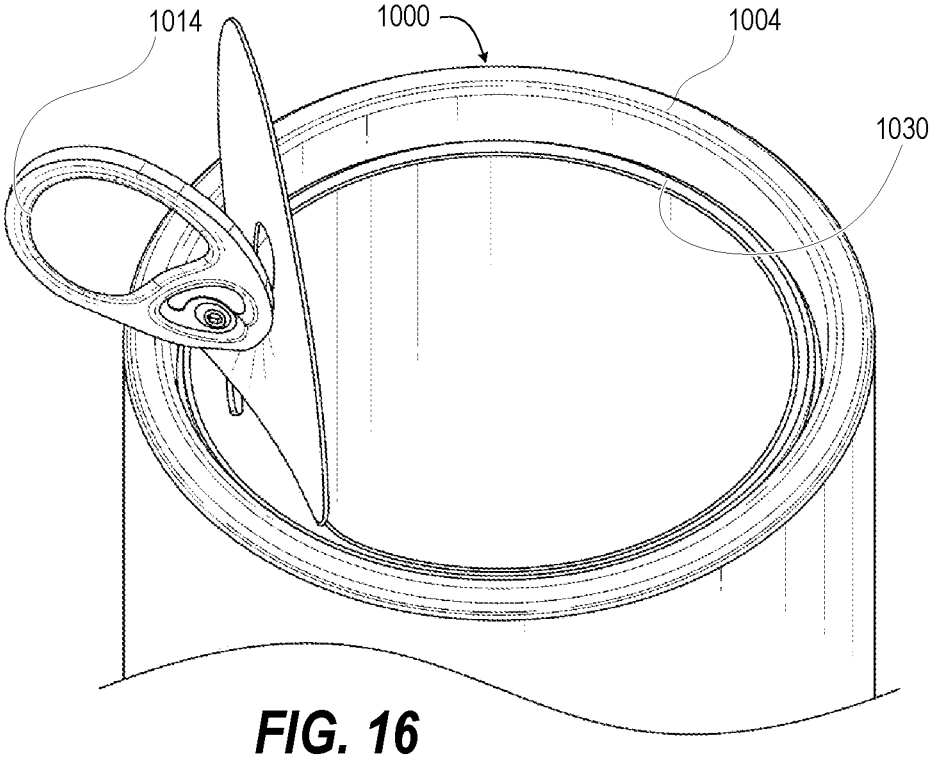
FIG. 16 is an isometric view illustrating the example stay-on tab bent actuated further from the full aperture pop top lid of FIG. 15 to expose a full aperture into a container, according to one or more embodiments.

FIG. 10 illustrates an example container 1000 having a full aperture spiral turning scored line 1002 formed into a full aperture pop top lid 1004. Scored line 1002 covers approximately 320° of the circumference of B64 end well 1006 of pop top lid 1004. An outer termination 1008 of scored line defines one side of a panel hinge 1010 with an adjacent outer extent 1012 of scored line 1002. FIG. 11 illustrates an example stay-on tab assembly 1014 centrally attached by rivet 1016 to the full aperture pop top lid 1004 of FIG. 10. A full aperture panel 1018 is defined by scored line 1002. An innermost portion 1020 of full aperture panel 1018 immediately contiguous to rivet 1016 that forms a primary bend location 1022 next to load side 1024 of the stay-on tab assembly 1014 having a graspable tab opening 1026 extending close to an outer wall 1028 of B64 end well 1006. Graspable tab opening 1026 is on an opposite side to load side 1024 of stay-on tab assembly 1014. FIG. 12 illustrates the example stay-on tab assembly 1014 attached to the full aperture pop top lid 1004 of FIG. 11. FIG. 13 illustrates the example stay-on tab assembly 1014 bent upward slightly from the full aperture pop top lid 1004 of FIG. 12. FIG. 14 illustrates the example stay-on tab assembly 1014 bent actuated further from the full aperture pop top lid 1004 of FIG. 13 to form an aperture in the scored line 1002. FIG. 15 illustrates the example stay-on tab assembly 1014 bent actuated further from the full aperture pop top lid 1004 of FIG. 14 to completely sheer the scored line. FIG. 16 illustrates the example stay-on tab assembly 1014 bent further from the full aperture pop top lid 1004 of FIG. 15 to expose a full aperture 1030 into a container, according to one or more embodiments;

As shown in FIGS. 10-16, disclosed is a new direction in full aperture end design, one that allows the exposure of the interior of a beverage can but retains the full aperture panel attached to the can body.

These advantages are accomplished by a uniquely shaped stay-on tab assembly 1014 that when lifted 90° to the end shell wall folds a portion of the scored panel upward (5), creating a small aperture in the beverage can. This exposure of the scored panel places the tab at 90° to the end shell wall.

The tab is constructed with a large finger ring opening (4) that can further be lifted out and away from the end shell. Due to the unique spiral shape of the scored panel (2) (6), the entire panel can now be removed from the beverage can and folded over the side wall of the can, substantially out of the way for access to the contents.

The initial upward lift of the stay-on tab creates a primary fold in the scored panel at roughly 90° to the end shell wall (7). This fold creates stiffness in the otherwise thin shell and allows a user to pull further upward using the large ring shape in the stay-on tab (4). The force of this pull is transverse across the face of the rivet, as opposed to other art in the genre which normally pulls either up or down on the face of the rivet. By changing this direction and pulling transversely on the rivet, pressure is applied to the remaining scored panel opening in such a way that little force is required to shear the remaining metal face. The combination of a transverse upward force on the rivet and a 90° primary bend in the scored panel in plane with this upward force allows for almost complete removal of the remaining end shell wall in one motion.

The score line that defines the end shell panel encompasses approximately 320° of the circumference of the end shell wall (2). Once this metal is removed in an outward direction, the tab assembly (8), the rivet (3) and the scored panel shape can be bent over the outer edge of the can end top utilizing remaining metal at (6) as a hinge. In this fashion a full aperture opening is affected.

Outward Turning Embodiments With Stay-On Tab

Figure 17:
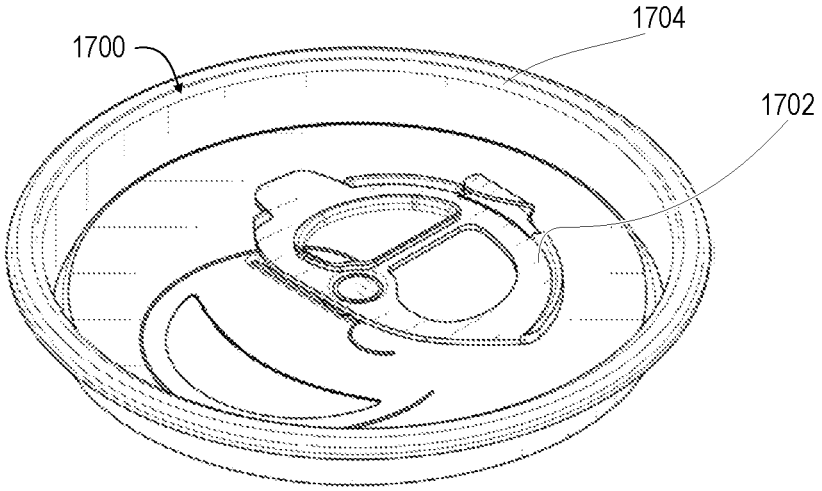
FIG. 17 is a top view illustrating an example outward turning stay-on tab attached to an example pop top lid, according to one or more embodiments.
Figure 18:
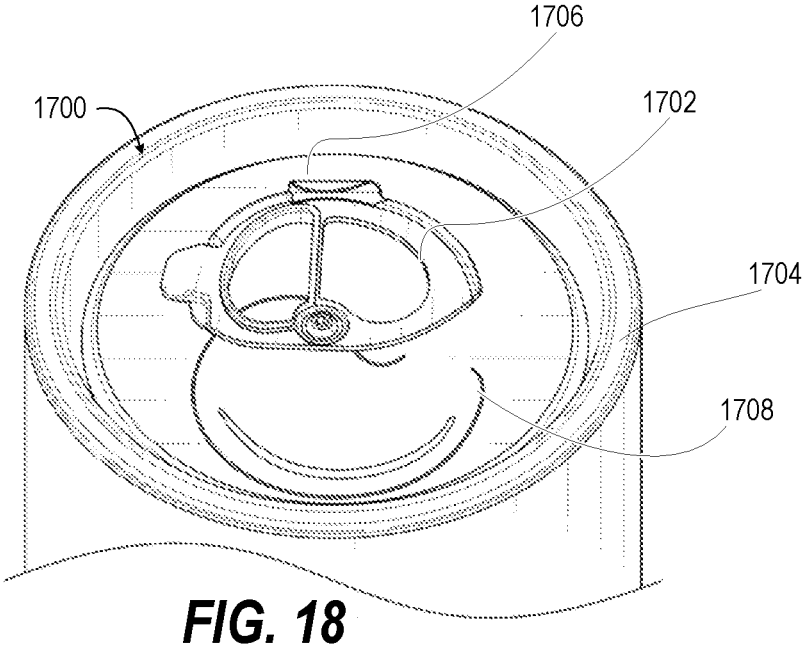
FIG. 18 is an isometric view illustrating the example outward turning stay-on tab bent upward slightly in a first direction from the pop top lid of FIG. 17 to expose a first actuator of the outward turning stay-on tab in a scored line, according to one or more embodiments.
Figure 19:
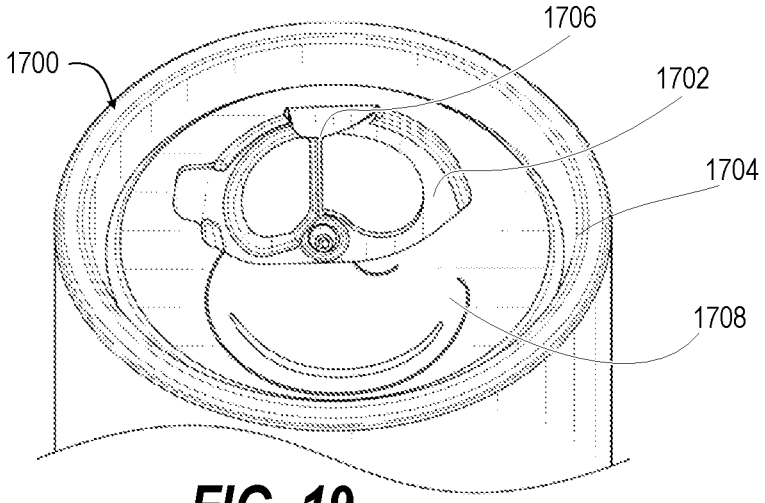
FIG. 19 is an isometric view illustrating the example outward turning stay-on tab of FIG. 18 bent upward further in the first direction from the pop top lid using the first actuator to open an aperture in a scored line, according to one or more embodiments.
Figure 20:
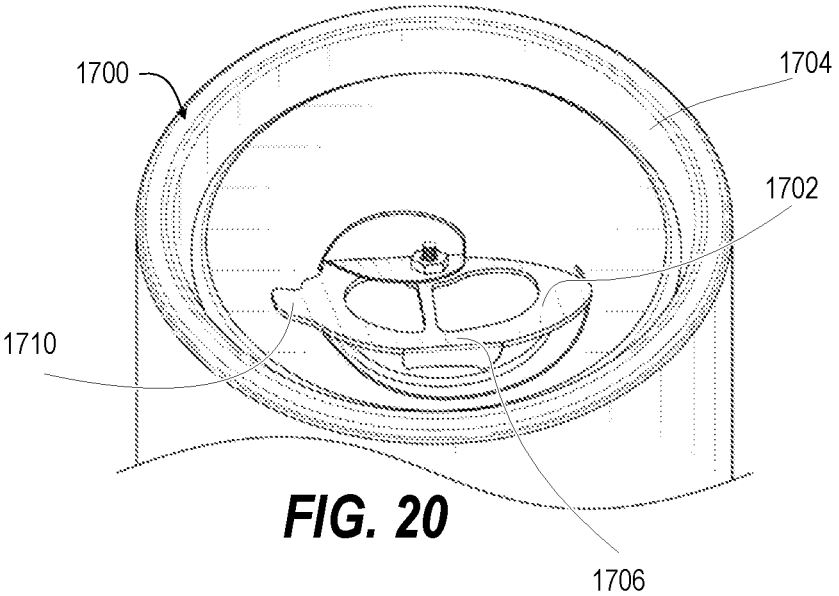
FIG. 20 is an isometric view illustrating the example outward turning stay-on tab of FIG. 18 bent upward further in the first direction from the pop top lid using the first actuator to position a second actuator that is transverse to the first actuator, according to one or more embodiments.
Figure 21:
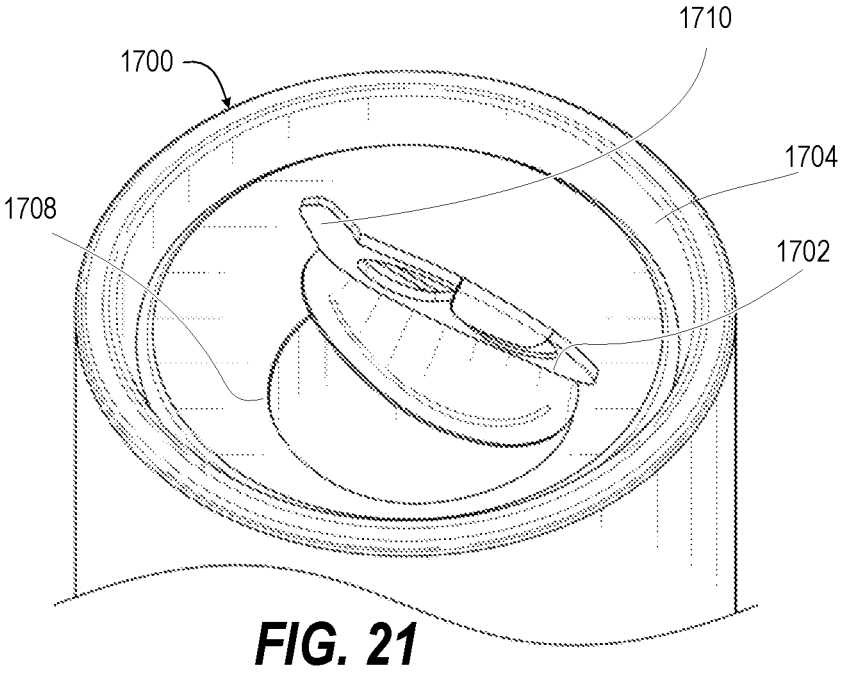
FIG. 21 is an isometric view illustrating the example outward turning stay-on tab of FIG. 18 bent upward in a second transverse direction from the pop top lid using the second actuator to further sheer open the scored line, according to one or more embodiments.
Figure 22:
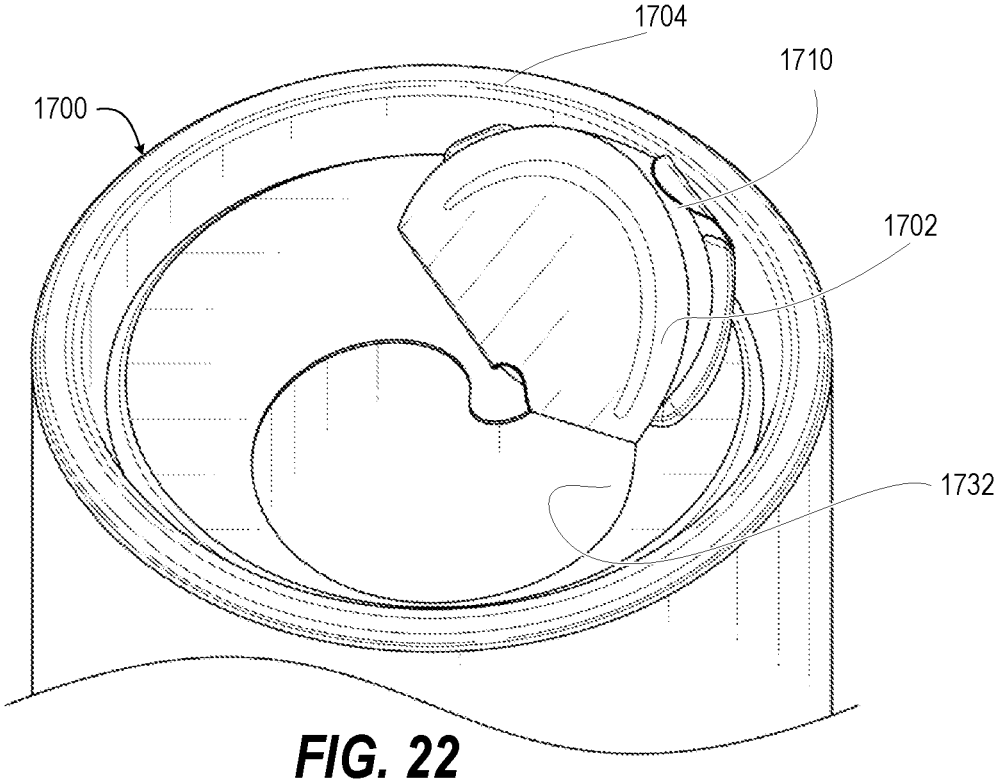
FIG. 22 is an isometric view illustrating the example outward turning stay-on tab of FIG. 18 bent upward further in the second transverse direction from the pop top lid using the second actuator to expose an aperture into contents of a container, according to one or more embodiments.

FIG. 17 illustrates an example container 1700 having outward turning stay-on tab assembly 1702 attached to an example pop top lid 1704. FIG. 18 illustrates the example outward turning stay-on tab assembly 1702 bent upward slightly in a first direction from the pop top lid 1704 of FIG. 17 to expose a first actuating point 1706 of the outward turning stay-on tab assembly 1702 in a scored line 1708. FIG. 19 illustrates the example outward turning stay-on tab assembly 1702 of FIG. 18 bent upward further in the first direction from the pop top lid 1704 using the first actuating point 1706 to open an aperture 1709 in the scored line 1708. FIG. 20 illustrates the example outward turning stay-on tab assembly 1702 of FIG. 18 bent upward further in the first direction from the pop top lid 1704 using the first actuating point 1706 to position a second actuating point 1710 that is transverse to the first actuating point 1706. FIG. 21 illustrates the example outward turning stay-on tab assembly 1702 of FIG. 20 bent upward in a second transverse direction from the pop top lid 1704 using the second actuating point 1710 to further sheer open the scored line 1708. FIG. 22 illustrates the example outward turning stay-on tab assembly 1702 of FIG. 21 bent upward further in the second transverse direction from the pop top lid 1704 using the second actuating point 1710 to complete opening an aperture 1709 exposing contents of the container 1700.

As shown in FIGS. 17-22, disclosed is one solution to an outward turning stay-on tab assembly 1702, a variation on the standard stay-on tab beverage can end shell closure. This design is composed of an end shell 1712, a typical rivet 1714 centered on that end shell 1712, a scored panel opening 1716 defined by a typical scored line 1708 that weakens a section of the end shell 1712 and a tab assembly 1702 attached to the end shell 1712 using a typical rivet 1714.

Primary aperture 1718 is gained by a lifting, pivoting bend 1720 using the tab assembly 1702 as a second-class lever that lifts the rivet 1714 and portion of the scored panel opening 1716 in an upward direction. An approximately 180° rotation of the tab assembly 1702 on the pivot point 1722 will create an aperture 1709 in the scored panel opening 1716 lifting out. In this embodiment, an embossing aids and directs this bend, though this is not an exclusive design element.

A second actuation/bend lifting at the thumb pull second actuating point 1710) will pull from within the fold of the primary bend in an upward direction. This motion allows the remaining scored panel opening 1709 to be pulled out of the end shell 1714 the scored panel opening 1716. The scored panel opening 1716, the rivet 1714 and the tab assembly 1702 all fold out of the top of the end shell 1712 along the second hinge line 1724. Once folded out, downward pressure on the scored panel opening 1716 will allow the panel edge 1726 to capture in the under-turned flange (first actuating point 1706).

Figure 23:
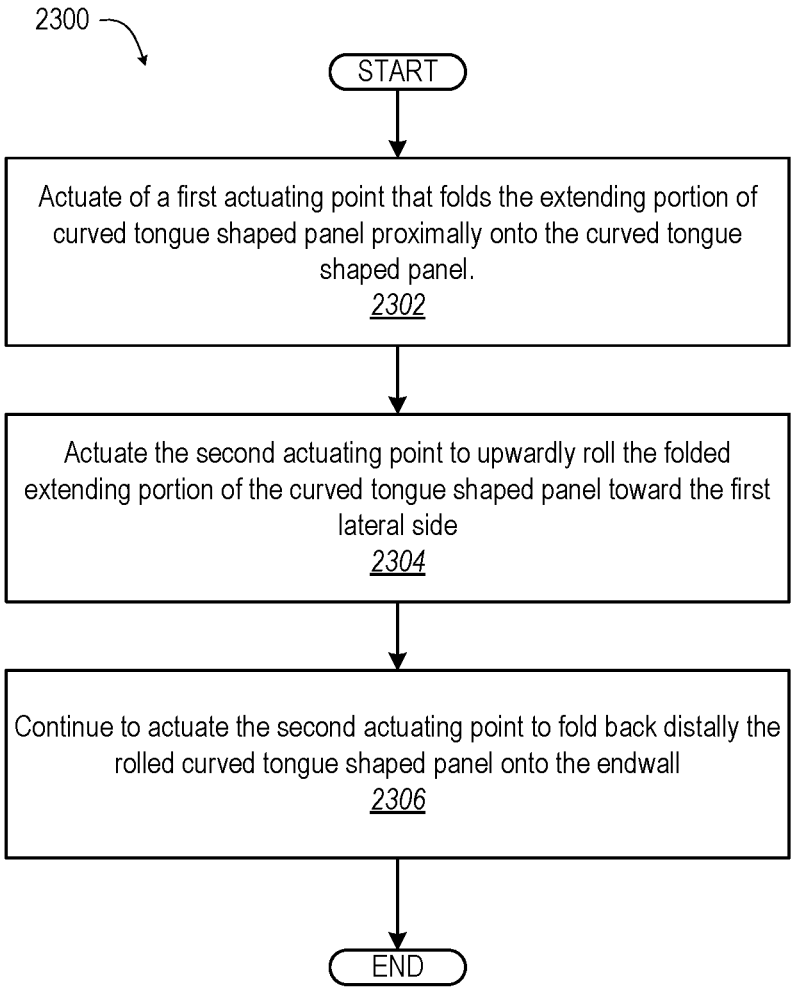
FIG. 23 is a flow diagram of a method of opening a container with a stay-on tab having two transverse actuating points, according to one or more embodiments.

FIG. 23 illustrates a method 2300 of opening a container 100 (FIG. 1) using a tab with two points of actuation. In one or more embodiments, method 2300 includes actuating of a first actuating point that folds the extending portion of curved tongue shaped panel proximally onto the curved tongue shaped panel (block 2302). The frangible score line terminates at each end substantially on the radial line extending from the lever mounting hole toward the first lateral side. Method 2300 includes actuating the second actuating point to upwardly roll the folded extending portion of the curved tongue shaped panel toward the first lateral side (block 2304). Method 2300 includes continued actuating of the second actuating point folds back distally the rolled curved tongue shaped panel onto the end wall (block 2306). Then method 2300 ends.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description. However, it is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A container comprising:

an end wall having a rivet and a frangible score line that defines a curved tongue shaped panel having a semi-circular arcing portion from a first lateral side to a proximal side and to a second lateral side, continuing to a distal looping portion that encompasses the rivet on a distal side and the first lateral side, the frangible score line terminating at each end substantially on a radial line extending from a lever mounting hole; and a tab that is riveted to the end wall to act as second-degree lever and comprising:

a first actuating point extending toward the distal looping portion of the frangible score line;

a second actuating point extending across a second lateral side portion of the frangible scored line; and a fulcrum portion extending opposite to the first actuating point and terminating within the curved tongue shape, wherein lifting of the first actuating point pulls upward on the curved tongue shaped panel at the distal looping portion imparting a shear force of the frangible score line to initiate upward rolling of an extended portion of the curved tongue shaped panel; and wherein:

actuation of the first actuating point folds an extending portion of the curved tongue shaped panel proximally onto the curved tongue shaped panel;

the frangible score line terminates at each end substantially on the radial line extending from the rivet toward the first lateral side; and actuation of the second actuating point upwardly rolls the folded extending portion of the curved tongue shaped panel toward the first lateral side; and continued actuation of the second actuating point folds back distally the rolled curved tongue shaped panel onto the end wall.

2. A container comprising:

an end wall having a rivet and a frangible score line that defines a curved tongue shaped panel having a semi-circular arcing portion from a first lateral side to a proximal side and to a second lateral side, continuing to a distal looping portion that encompasses the rivet on a distal side and the first lateral side, the frangible score line terminating at each end substantially on a radial line extending from a lever mounting hole; and a tab that is riveted to the end wall to act as second-degree lever and comprising:

a first actuating point extending toward the distal looping portion of the frangible score line; and a fulcrum portion extending opposite to the first actuating point and terminating within the curved tongue shape, wherein lifting of the first actuating point pulls upward on the curved tongue shaped panel at the distal looping portion imparting a shear force of the frangible score line to initiate upward rolling of an extended portion of the curved tongue shaped panel; and wherein, subsequent to lifting of the first actuating point to impart the shear force, the tab is configured for continuing a rotation of approximately 180° rotation to fold out a scored panel, the first actuating point positioned to shear an opposite side of the frangible score line.

3. The container of claim 2, wherein the tab further comprises a second actuating point extending across a second lateral side portion of the frangible scored line and that is actuated after the first actuating point to roll up the curved tongue shaped panel toward the first lateral side.

4. The container of claim 2, wherein the first actuating point when rotated to a folded out position comprises an under-turned flange shaped and positioned to capture a panel edge of the scored panel in response to downward pressure on the scored panel.

5. The container of claim 2, further comprising an embossing across scored panel positioned to aid bending of the scored panel to a folded out position.

* * * * *